US005829548A

United States Patent [19]

Ostrobrod

[11] Patent Number: 5,829,548

[45] Date of Patent: Nov. 3, 1998

[54] SAFETY DEVICE INSPECTION INDICATOR

[76] Inventor: Meyer Ostrobrod, 2070 Bennett Rd., Philadelphia, Pa. 19116

[21] Appl. No.: 705,404

[22] Filed: Jul. 29, 1996

[51] Int. Cl.[6] ..... E06C 5/34

[52] U.S. Cl. ..... 182/18; 182/5; 182/234; 182/241

[58] Field of Search ..... 182/5, 18, 231, 182/232, 234, 241

[56] References Cited

U.S. PATENT DOCUMENTS

| | | | |
|---|---|---|---|
| 291,326 | 1/1884 | French | 182/18 |
| 4,253,544 | 3/1981 | Dalmaso | 182/18 X |
| 4,489,919 | 12/1984 | Ostrobrod | 254/346 |
| 4,660,679 | 4/1987 | Ostrobrod | 182/18 |
| 4,877,110 | 10/1989 | Wolner | 182/18 X |
| 5,186,289 | 2/1993 | Wolner et al. | 188/180 |
| 5,220,977 | 6/1993 | Wolner | 182/18 |
| 5,316,103 | 5/1994 | Bell et al. | 182/18 |
| 5,343,981 | 9/1994 | Schroemges et al. | 182/18 X |

*Primary Examiner*—Derek J. Berger
*Assistant Examiner*—Richard M. Smith
*Attorney, Agent, or Firm*—Norman E. Lehrer

[57] ABSTRACT

An inspection indicator for a fall prevention safety device of the type which includes a housing, a drum rotatably mounted in the housing, a cable adapted to be wound around the drum, and a centrifugally operated brake mechanism which is activated in response to an initial fast rotation of the drum in the unwinding direction and brakes the rotation of the drum to prevent further unwinding thereof. The inspection indicator comprises a pin which is secured to and extends from the brake mechanism and a spring loaded member which is releasably secured to the housing of the safety device against the restoring force of a spring. The pin is adapted to release the spring loaded member thereby causing the same to be ejected outwardly from the safety device in order to indicate that the safety device has been activated and/or to indicate that the safety device has been in use for a predetermined period of time.

20 Claims, 3 Drawing Sheets

SAFETY DEVICE INSPECTION INDICATOR

BACKGROUND OF THE INVENTION

The present invention is directed toward a safety device inspection indicator and, more particularly, toward such an indicator which allows an inspector to readily determine whether the brake mechanism of the safety device has been activated or if the safety device has been in service for a predetermined period of time.

The invention has particular use with fall protection devices such as shown in Applicant's U.S. Pat. No. 4,511,123. More specifically, a fall prevention device of this kind is comprised of a housing which is adapted to be suspended from an elevated structure. A cable winding drum is rotatably mounted in the housing and a spiral spring drives the drum in a direction which continuously tends to wind the cable around the drum. A centrifugally operated brake mechanism responds to an initial fast rotation of the drum in the unwinding direction and brakes the rotation of the drum to prevent further unwinding thereof.

In use, these known safety devices are fixed to a structure such as a building, bridge or the like and the cable extending therefrom is fastened to a worker's belt or harness. Under normal working conditions, the cable is drawn in and out of the housing at a reasonable speed as the worker moves from one place to another. The centrifugal brake is not engaged as the speed of rotation of the drum is relatively slow. In the event of a fall, however, the cable is drawn out rapidly and the drum is then rotated at a high speed. As a result, the centrifugally operated brake is actuated thereby preventing further rotation of the drum which stops the cable from being drawn out. This prevents injury or death to the worker which otherwise would occur as a result of the fall.

Government safety regulations require that such fall protection devices be physically taken from the support structure and delivered to a manufacturing plant for examination and repair, if necessary, in the event that a worker using the device falls and activates the centrifugal brake. However, not everyone complies with the law. Specifically, contractors often do not take the fall protection device to the manufacturer for examination after the centrifugal brake has been activated as a result of a fall of a worker.

The relevant regulations also require that these fall protection devices be inspected by the manufacturer on an annual basis. Once again, contractors often do not comply with these relevant rules.

Accordingly, there is a need for a mechanism which indicates that the brake mechanism on the fall prevention safety device has been activated and/or that the safety device has been in use for a predetermined period of time. There is also a need for such a mechanism that cannot easily conceal the fact that it is time for the safety device to be inspected.

SUMMARY OF THE INVENTION

It is an object of this invention to provide a safety device inspection indicator which provides a visual indication that the brake mechanism of a safety device has been actuated to prevent the fall of a worker.

It is a further object of the invention to provide such an inspection indicator that provides a visual indication when the safety device has not been inspected for a predetermined period of time.

It is yet another object of the invention to provide a safety device inspection indicator which is ejected from the safety device when it is time for the same to be inspected.

In accordance with the illustrative embodiments, demonstrating features and advantages of the present invention, there is provided a safety device inspection indicator for a fall prevention safety device of the type which includes a housing, a drum rotatably mounted in the housing, a cable adapted to be wound around the drum, and a centrifugally operated brake mechanism which is activated in response to an initial fast rotation of the drum in the unwinding direction and brakes the rotation of the drum to prevent further unwinding thereof. The inspection indicator comprises means for indicating a prolonged activation of the brake mechanism of the safety device and for indicating that the safety device has been in use for a predetermined period of time.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
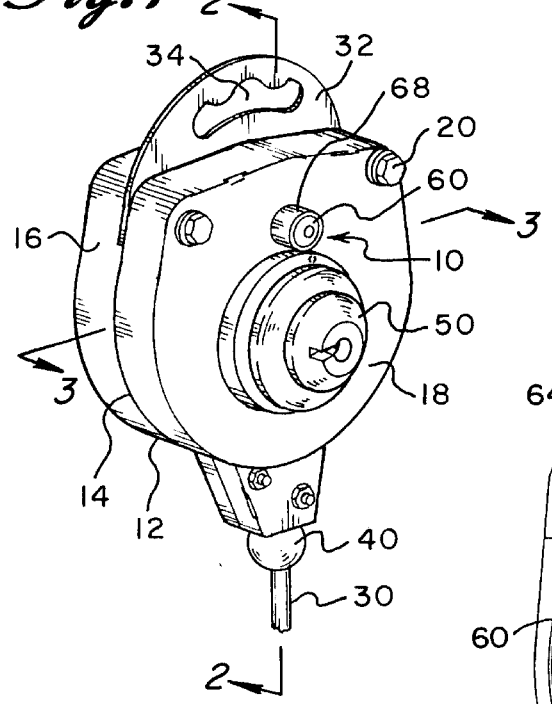
FIG. 1 is a perspective view of the safety device inspection indicator mounted to a safety device and constructed in accordance with the principles of the present invention.

Referring now to the drawings in detail wherein like reference numerals have been used throughout the various figures to designate like elements, there is shown in FIG. 1 a safety device inspection indicator constructed in accordance with the principles of the present invention and designated generally as 10.

The safety device inspection indicator 10 is mounted to a safety device 12 of the type generally known in the industry. The safety device 12 includes a housing 14 formed by joining two complementary housing portions 16 and 18. A plurality of bolts such as shown at 20 in FIGS. 1 and 2 maintain the two portions 16 and 18 securely together.

Figure 5:
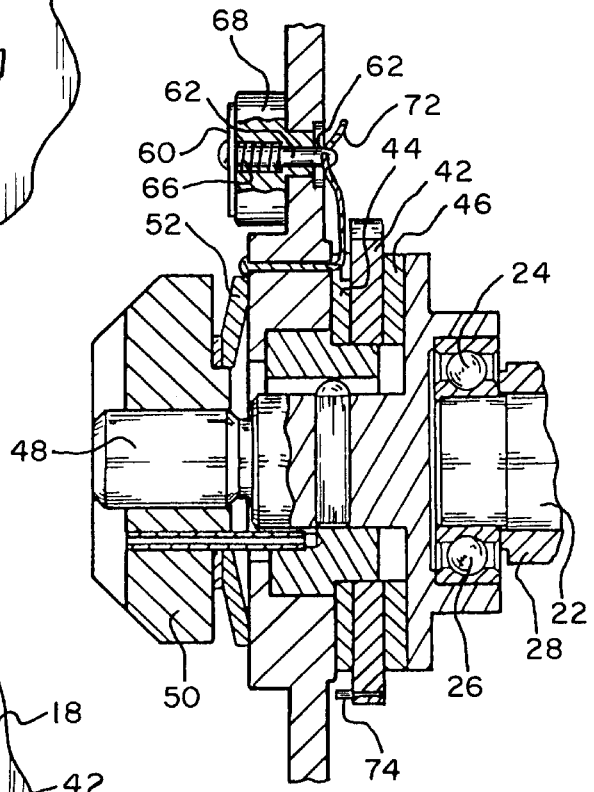
FIG. 5 is a cross-sectional view taken along lines 5—5 of FIG. 4.
Figure 6:
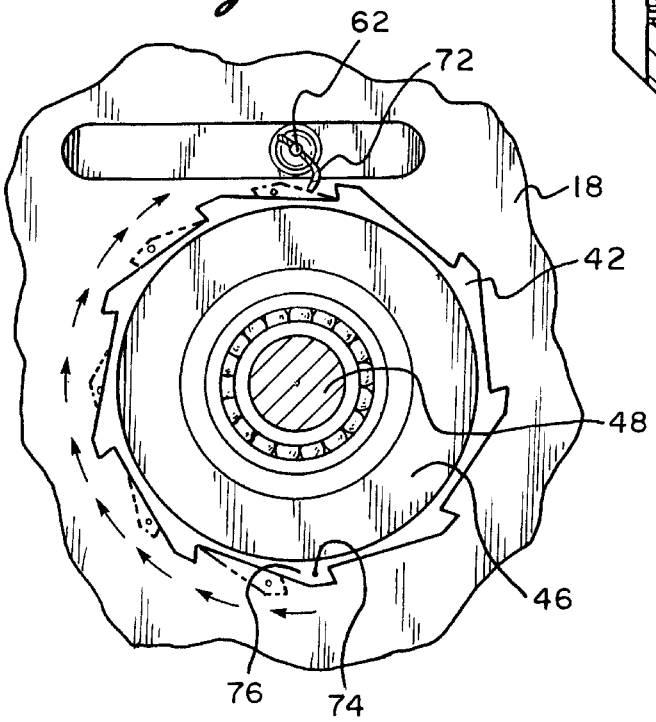
FIG. 6 is a view similar to FIG. 4 showing the rotation of the ratchet wheel of the brake mechanism.

Referring to FIG. 5, rotatably mounted within the housing 14 is a horizontally arranged shaft 22. Bearings 24 and 26 allow the shaft 22 to rotate freely within the housing. Securely mounted on the shaft 22 so as to rotate therewith is a drum 28. A rope or cable 30 is wound about the drum 28.

Figure 2:
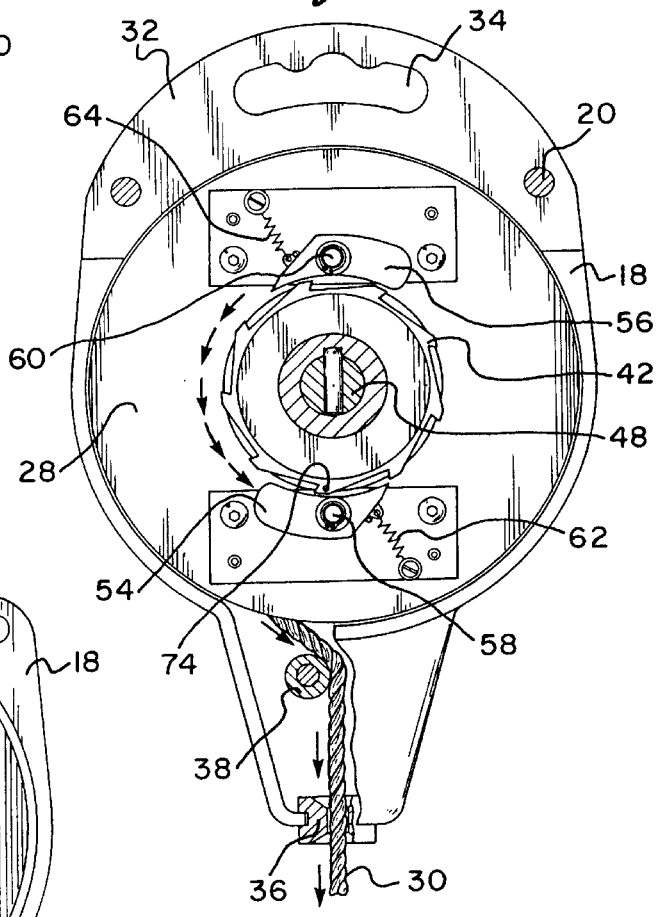
FIG. 2 is a cross-sectional view taken along lines 2—2 of FIG. 1.
Figure 3:
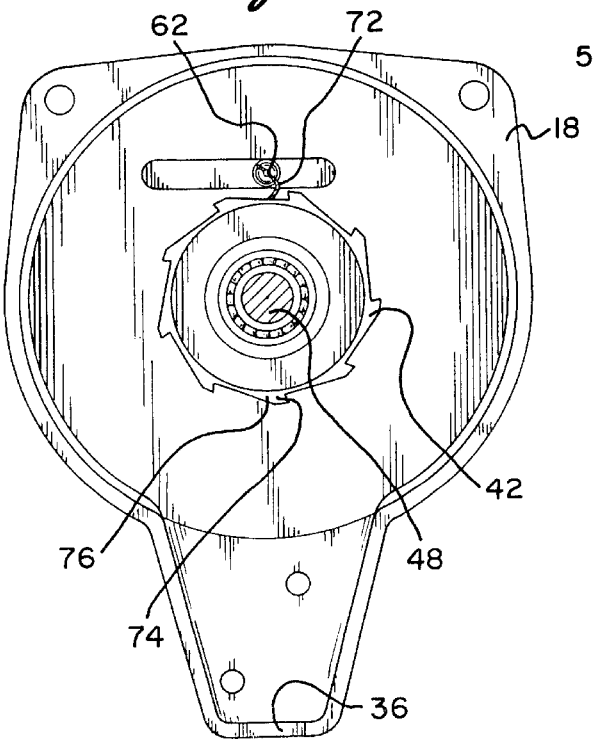
FIG. 3 is a cross-sectional view taken along lines 3—3 of FIG. 1.
Figure 4:
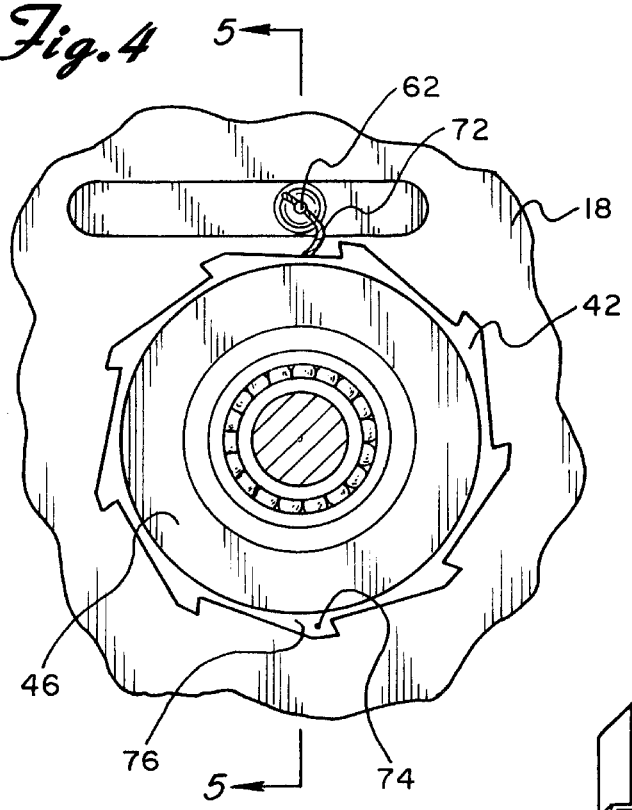
FIG. 4 is a partial elevational view of a portion of the brake mechanism of the safety device.

Extending upwardly from the housing 14 is a support member 32 which includes an opening 34 which may be utilized to mount the entire safety device 12 to a support structure (FIGS. 1 and 2). The bottom of the housing 14 has an opening 36 therein which allows the cable to pass therethrough after the same has been guided to the opening by a guide roller 38 (FIG. 2). A stopper 40 carried by the cable 30 prevents the end of the cable from being drawn into the housing 14. Preferably, the cable terminates in a hook, eye or the like for connection to a harness worn by a worker.

Also located within the housing 14 is a spiral spring which has one end secured to the housing and another end secured to the shaft 22. The spring maintains a continuous turning force on the shaft 22 and thus the drum 28 so that the cable 30 continuously tends to be wound up on the drum 28.

The centrifugally actuated brake mechanism is shown most clearly in FIGS. 2 and 5. The brake mechanism includes a ratchet wheel 42 which is mounted for rotation but is clamped between brake pads or friction disks 44 and 46 (FIG. 5). The ratchet wheel 42 and disks 44 and 46 are held adjacent the inner wall of the housing portion 18 by a bolt 48 (FIGS. 2 and 5). A nut 50 maintains the bolt in position (FIGS. 1 and 5). Tension for the brake mechanism, which is comprised of brake pads 44 and 46 and the ratchet wheel 42, is provided by spring 52 (FIG. 5).

A pair of pawls 54 and 56 are pivotally mounted on one of the outer surfaces of the drum 28 by pivot pins 58 and 60 (FIG. 2). These pawls are normally maintained in a non-operative position by springs 61 and 63. The pawls 54 and 56 normally rotate with the drum 28 and remain in orientation with respect to the same. However, should the drum rotate very quickly, centrifugal force causes the back end of each of the pawls 54 and 56 to move outwardly thereby causing the forward end of each pawl to engage the ratchet wheel 42 and the entire drum 28 then slows down and eventually stops as a result of the forces of the friction disks 44 and 46. The centrifugal brake mechanism employed in the safety device 12 of the present invention is more fully described in Applicant's prior U.S. Pat. No. 4,511,123, the subject matter of which is incorporated herein by reference.

Figure 8:
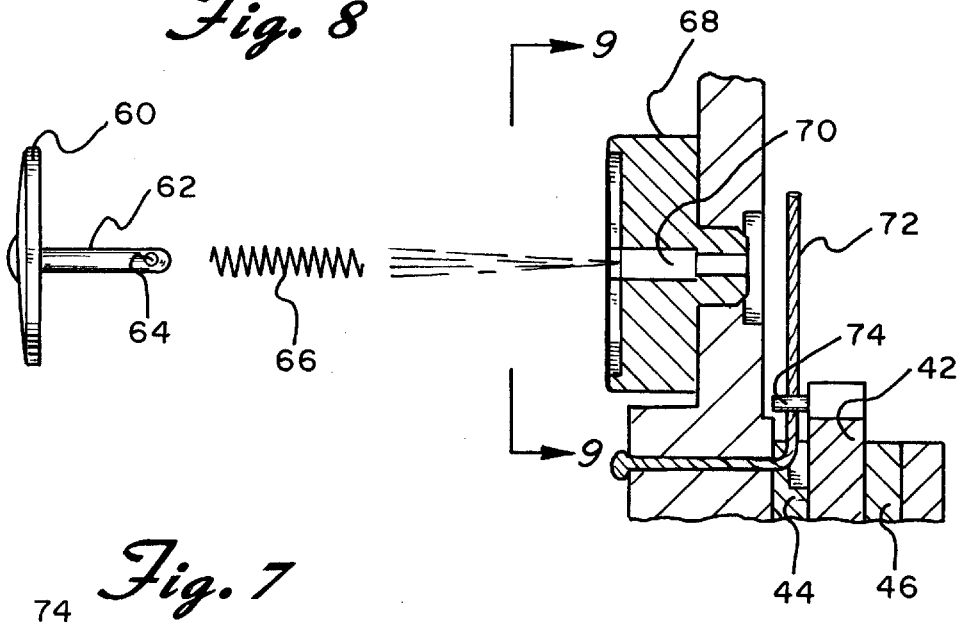
FIG. 8 is a cross-sectional exploded view taken along lines 8—8 of FIG. 7.
Figure 7:
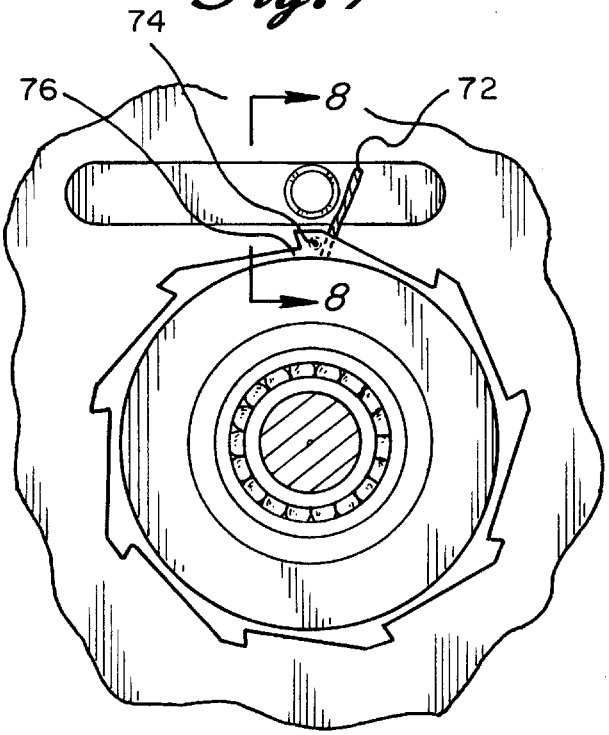
FIG. 7 is a view similar to FIG. 6 showing the pin on the ratchet wheel removing a string from an eyelet in the stem of a spring loaded button.
Figure 9:
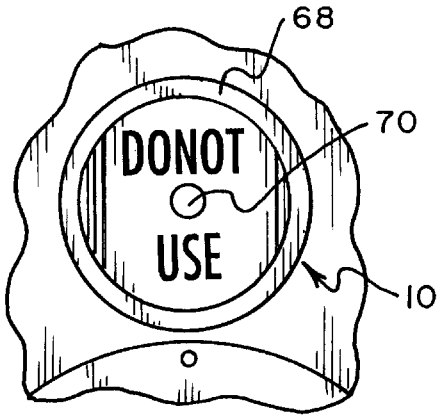
FIG. 9 is a cross-sectional view taken along lines 9—9 of FIG. 8.

Referring to FIG. 8, the safety device inspection indicator 10 of the present invention includes a button 60 with a stem 62 extending rearwardly from one side thereof. The free end of the stem 62 includes an eyelet 64 therein. Positioned around the stem 62 is a spring 66. In the preferred embodiment, a cylindrical casing 68 is secured in and extends outwardly from the housing portion 18 (FIGS. 8 and 9). The cylindrical casing has a hole 70 formed therethrough which communicates with an opening in the portion 18 of the housing 14.

The safety device inspection indicator is mounted in the housing 14 of the safety device 12 in the following manner. The tip of the stem 62 is passed through the hole 70 in the cylindrical casing 68 and through the opening in the housing portion 18 so that the eyelet 64 is positioned in the housing 14. As the tip of the stem is passed into the housing, the spring 66 is compressed between the cylindrical casing 68 and the button 60. The tip of the stem 62 is maintained in the housing 14 against the restoring force of the spring 66 by passing the free end of a string 72 or the like, which has its other end secured to the inside of the safety device, through the eyelet 64 in the stem 62. A pin 74 extends from a tooth 76 on the ratchet wheel 42. The pin is adapted to activate the inspection indicator 10 as more fully described below.

The safety device inspection indicator is utilized in the following manner. The safety device 12 is suspended from a suitable support structure by utilizing the opening 34 at the top end of the housing 14. The cable 30 is then connected to a worker's belt or harness through the use of a hook or the like. In the event the worker falls by mistake, the cable 30 is rapidly drawn out of the housing. As the cable is drawn out, the drum 28 rotates rapidly. The centrifugal force created causes the pawls 54 and 56, which are mounted to the outer surfaces of the drum by pivot pins 58 and 60, to overcome the force of the springs 61 and 63 and engage the ratchet wheel 42. When the ratchet wheel is engaged by the pawls, it will rotate a number of times with the drum until the brake pads 44 and 46 absorb the force of the worker's weight and cause the drum 28 to come to a halt.

While the ratchet wheel rotates, the pin 74, which extends from the ratchet wheel 42, draws the string 72 from the eyelet 64 thereby allowing the restoring force of the spring 66 to cause the button 60 to be ejected from the cylindrical casing 68 (FIG. 8). The inside wall of the cylindrical casing preferably has indicia located thereon, such as the phrase "DO NOT USE," to indicate that it is time for the safety device 12 to be inspected (FIG. 9).

The spring 66 causes the button to be ejected a relatively significant distance from the safety device so that it is difficult to relocate and replace on the safety device. This is important as government safety regulations require that every safety device be taken to the manufacturer once the brake mechanism has been activated to stop a worker's fall. Once the safety device 12 has been taken to the manufacturing plant and inspected, a new spring loaded button is secured to cylindrical casing to hide the warning indicia in the manner discussed above.

It should also be noted that safety regulations require every safety device to be taken to the manufacturing plant after it has been in use for one year even if it has not been used to stop a worker's fall. Furthermore, regulations require that a worker pull quickly on the cable 30 each day before using the fall prevention safety device 12 to make sure that the brake mechanism is working properly. It has been determined that an average pull on the cable 30 causes the ratchet wheel 42 to move just less than one degree.

Accordingly, if the safety device is put to use substantially every workday, it will be moved approximately 220 times per year. This translates into the ratchet wheel 42 moving approximately 180°. Therefore, when the brake mechanism is assembled, the pin 74 located on tooth 76 of the ratchet wheel 42 is positioned approximately 180° from the string 72. It follows that after approximately one year the ratchet wheel will have moved approximately 180° and, therefore, the pin 74 will engage the string 72 and cause the button 60 to be ejected from the safety device 12 thereby indicating that the device has been in service for approximately one year and should be inspected.

The present invention may be embodied in other specific forms without departing from the spirit or essential attributes thereof and accordingly reference should be made to the appended claims rather than to the foregoing specification as indicating the scope of the invention.

What is claimed is:

1. An inspection indicator in combination with a fall prevention safety device, said safety device comprising a housing, a drum rotatably mounted in said housing, a cable adapted to be wound around said drum, and a centrifugally operated brake mechanism which is activated in response to an initial fast rotation of said drum in the unwinding direction and brakes the rotation of said drum to prevent further unwinding thereof, said inspection indicator mounted within said housing and comprising means for indicating a prolonged activation of said brake mechanism.

2. The combination of claim 1 wherein said indicating means comprises: a pin secured to and extending from said brake mechanism, a spring loaded member, and means for releasably retaining said spring loaded member to said housing of said safety device, said pin being adapted to release said retaining means thereby causing said spring loaded member to be ejected outwardly from said safety device upon prolonged activation of said brake mechanism.

3. The combination of claim 2 wherein said spring loaded member includes a button, a stem with an eyelet therein, and a spring covering said stem, said stem extending from said button and into said housing, said spring being compressed between said button and said housing, said releasably retaining means engaging said eyelet thereby retaining said spring loaded member against the restoring force of said spring.

4. The combination of claim 3 wherein said releasably retaining means includes a string which has one end secured to the inside of said housing of said safety device and a free end passing through said eyelet in said stem of said spring loaded member, said pin being adapted to contact and remove said string from said eyelet.

5. The inspection indicator of claim 3 wherein said button covers a visual sign placed on said housing which indicates that said brake mechanism has been activated.

6. An inspection indicator in combination with a fall prevention safety device, said safety device comprising a housing, a drum rotatably mounted in said housing, a cable adapted to be wound around said drum, and a centrifugally operated brake mechanism which is activated upon an initial fast rotation of said drum in the unwinding direction and brakes the rotation of said drum to prevent further unwinding thereof, said inspection indicator mounted within said housing and comprising means for indicating that said fall prevention safety device has been in use for a predetermined period of time.

7. The inspection indicator of claim 6 wherein said indicating means includes: a pin secured to and extending from said brake mechanism, a spring loaded member, and means for releasably retaining said spring loaded member to said housing of said safety device, said pin being adapted to release said retaining means thereby causing said spring loaded member to be ejected outwardly from said safety device after said safety device has been in use for a predetermined period of time.

8. The inspection indicator of claim 7 wherein said spring loaded member includes a button, a stem with an eyelet therein, and a spring covering said stem, said stem extending from said button and into said housing, said spring being compressed between said button and said housing, said releasably retaining means engaging said eyelet thereby retaining said spring loaded member against the restoring force of said spring.

9. The inspection indicator of claim 8 wherein said releasably retaining means includes a string which has one end secured to the inside of said housing of said safety device and a free end passing through said eyelet in said stem of said spring loaded member, said pin adapted to contact and remove said string from said eyelet.

10. The inspection indicator of claim 8 wherein said button covers a visual signal placed on said housing which indicates that said safety device has been in use for a predetermined period of time.

11. The inspection indicator of claim 7 wherein said pin is positioned adjacent the periphery of said brake mechanism at a predetermined distance from said releasably retaining means, said brake mechanism being adapted to slightly rotate in response to a passing application of force on said cable thereby incrementally moving said pin closer to said releasably retaining means.

12. An inspection indicator in combination with a fall prevention safety device, said safety device comprising a housing, a drum rotatably mounted in said housing, a cable adapted to be wound around said drum, and a centrifugally operated brake mechanism which is activated in response to an initial fast rotation of said drum in the unwinding direction and brakes the rotation of said drum to prevent further unwinding thereof, said inspection indicator mounted within said housing and comprising means for indicating a prolonged activation of said brake mechanism of said safety device and for indicating that said safety device has been in use for a predetermined period of time.

13. The inspection indicator of claim 12 wherein said indicating means includes: a pin secured to and extending from said brake mechanism, a spring loaded member, and means for releasably retaining said spring loaded member to said housing of said safety device, said pin adapted to release said retaining means thereby causing said spring loaded member to be ejected outwardly from said safety device upon prolonged activation of said brake mechanism or after said safety device has been in use for a predetermined period of time.

14. The inspection indicator of claim 13 wherein said spring loaded member includes a button, a stem with an eyelet therein, and a spring covering said stem, said stem extending from said button and into said housing, said spring being compressed between said button and said housing, said releasably retaining means engaging said eyelet thereby retaining said spring loaded member against the restoring force of said spring.

15. The inspection indicator of claim 14 wherein said releasably retaining means includes a string which has one end secured to the inside of said housing of said safety device and a free end passing through said eyelet in said stem of said spring loaded member, said pin adapted to contact and remove said string from said eyelet.

16. The inspection indicator of claim 14 wherein said button covers a visual signal placed on said housing which indicates that said brake mechanism has been activated or said safety device has been in use for a predetermined period of time.

17. The inspection indicator of claim 14 wherein said pin is positioned adjacent the periphery of said brake mechanism at a predetermined distance from said releasably retaining means, said brake mechanism adapted to slightly rotate in response to a passing application of force on said cable thereby incrementally moving said pin closer to said releasably retaining means.

18. The combination of claim 1 wherein said means for indicating includes means mounted on said brake mechanism for activating said inspection indicator.

19. The combination of claim 6 wherein said means for indicating includes means mounted on said brake mechanism for activating said inspection indicator.

20. The combination of claim 12 wherein said means for indicating includes means mounted on said brake mechanism for activating said inspection indicator.

* * * * *